US005164076A

United States Patent [19]

Zarchy et al.

[11] Patent Number: 5,164,076

[45] Date of Patent: Nov. 17, 1992

[54] PROCESS FOR THE ADSORPTION OF HYDROGEN SULFIDE WITH CLINOPTILOLITE MOLECULAR SIEVES

[75] Inventors: Andrew S. Zarchy, Amawalk; Richard Correia, Elmsford; Chien C. Chao, Millwood, all of N.Y.

[73] Assignee: UOP, Des Plaines, Ill.

[21] Appl. No.: 644,796

[22] Filed: Jan. 22, 1991

[51] Int. Cl.[5] ..... C10G 29/00

[52] U.S. Cl. ..... 208/245; 208/91; 208/134; 208/141; 208/213; 208/248; 208/307; 585/823; 423/243.08

[58] Field of Search ..... 208/134, 245, 248, 307, 208/141, 91, 213; 585/823; 423/244

[56] References Cited

U.S. PATENT DOCUMENTS

| | | | |
|---|---|---|---|
| 2,937,215 | 5/1960 | Bleich et al. | 260/683.73 |
| 2,951,888 | 9/1960 | Carr | 260/683.65 |
| 3,069,349 | 12/1962 | Meiners | 208/85 |
| 3,540,998 | 11/1970 | Bercik et al. | 208/91 |
| 3,725,299 | 4/1973 | Turnock et al. | 208/307 X |
| 3,864,460 | 2/1975 | Connell | 423/574 |
| 3,894,103 | 7/1975 | Chang et al. | 208/141 X |
| 4,259,168 | 3/1981 | Liotta | 208/422 X |
| 4,510,254 | 4/1985 | Morris et al. | 502/64 X |
| 4,513,098 | 4/1985 | Tsao | 208/134 X |
| 4,717,552 | 1/1988 | Carnell et al. | 423/230 |
| 4,795,545 | 1/1989 | Schmidt | 208/91 |
| 4,830,733 | 5/1989 | Nagji et al. | 208/208 R |
| 4,830,734 | 5/1989 | Nagji et al. | 208/208 R |
| 4,831,206 | 5/1989 | Zarchy | 585/737 |
| 4,831,207 | 5/1989 | O'Keefe et al. | 585/737 |
| 4,831,208 | 5/1989 | Zarchy | 585/737 |
| 4,935,580 | 6/1990 | Chao et al. | 585/820 |
| 4,940,532 | 7/1990 | Peer et al. | 208/134 X |
| 4,964,889 | 10/1990 | Chao | 55/58 |

*Primary Examiner*—Theodore Morris
*Assistant Examiner*—William C. Diemler
*Attorney, Agent, or Firm*—Thomas K. McBride; John G. Tolomei; Warren K. Volles

[57] ABSTRACT

Processes are disclosed for the separation of hydrogen sulfide from feedstreams containing hydrogen sulfide and hydrocarbons by adsorption using a clinoptilolite adsorbent containing cations having ionic radii of from about 1.10 to 1.40 Angstroms. The processes can provide substantially enhanced adsorption capacities as compared with other adsorbents such as Zeolite 4A. As a result, a throughput of existing sulfur adsorption plants can be increased, e.g., by about 100%. The processes can be operated at elevated adsorption temperatures, e.g., greater than about 200° F., and thus are particularly suitable when integrated with other processing steps such as hydrocarbon conversion reactions that utilize catalysts which are sulfur-sensitive. In addition, the clinoptilolite adsorbents of the present invention have a high tolerance to environments that comprise halides, e.g., HCl.

20 Claims, 1 Drawing Sheet

PROCESS FOR THE ADSORPTION OF HYDROGEN SULFIDE WITH CLINOPTILOLITE MOLECULAR SIEVES

The removal of sulfur from hydrocarbon feedstreams is an important separation in the oil, gas and chemical process industries. There are many operations in these industries in which it is necessary to remove sulfur to conform to a product specification or in which there is at least one processing step which is sensitive to sulfur present in the feedstream.

Often, in hydrocarbon conversion processes where hydrocarbon feeds are catalytically converted to hydrocarbon products, the catalyst used in the conversion process is sensitive to sulfur. That is, the presence of sulfur in the feedstream deactivates or inhibits in some way the catalyst in the conversion process. Generally, the presence of such a sulfur-sensitive step will necessitate the removal of all or most of the sulfur prior to its being introduced into the sulfur-sensitive step.

Typical of hydrocarbon conversion processes that employ sulfur-sensitive conversion catalysts are paraffin isomerization and reforming. In paraffin isomerization a feedstream containing normal paraffins in about the $C_4$ to $C_7$ carbon range is contacted with an isomerization catalyst as effective conditions to form branched chain paraffins. In catalytic reforming a feedstream containing paraffins in about the $C_6$ to $C_{12}$ carbon range is contacted with a reforming catalyst in order to convert the feedstream to a product having a higher octane value than the feedstream. A variety of products are formed during the reforming reactions, but one common characteristic is that the product usually contains an increased concentration of aromatic hydrocarbons relative to the feedstream.

In typical hydrocarbon conversion processes that have a sulfur-sensitive step, sulfur is removed by a hydrodesulfurization step. Such a hydrodesulfurization step generally involves passing a heated, vaporized feedstream to a hydrotreating reactor which catalytically converts the sulfur in the feedstream to hydrogen sulfide and any nitrogen present to ammonia, passing the product to a condenser in which a portion of the gaseous hydrogen sulfide is condensed with the remainder of the hydrogen sulfide leaving as overhead, and passing the liquid product to a stream stripper column wherein the condensed hydrogen sulfide in the liquid product is removed. In lieu of the steam stripper, a hydrogen sulfide adsorption bed may also be used to adsorb hydrogen sulfide from the liquid product. Regardless of whether a steam stripper or an adsorber is utilized to remove the hydrogen sulfide the hydrocarbon stream, now having essentially all of its sulfur content removed, is typically reheated and vaporized once again prior to being introduced to the hydrocarbon conversion reactor.

While such a hydrodesulfurization technique for sulfur (and nitrogen) removal is an effective means for dealing with the presence of sulfur, it is extremely costly. In fact, the conventional practice is to run the hydrodesulfurization (also known as hydrotreating) unit separately and independently from the sulfur-sensitive step, e.g., isomerization unit, which often adds to the complexity of the process and to the overall costs. So too, the necessity of repeatedly having to heat and cool the feedstream so as to effect a phase change to accommodate different process steps can also adversely affect the economics and efficiency of the overall process.

An alternative approach to the conventional hydrodesulfurization method described above is set forth in U.S. Pat. No. 4,831,208 issued to Zarchy, which discloses a method of temporarily removing a deleterious component such as sulfur by adsorption and thereafter passing the purified feedstream to a hydrocarbon conversion process that is sensitive to the deleterious component and then using at least a portion of an effluent stream from the hydrocarbon conversion process in order to desorb the deleterious component from the adsorber bed. A particularly useful feature of the process disclosed by the above-identified patent is that the sulfur adsorption step, the sulfur-sensitive hydrocarbon processing step, as well as the adsorbent regeneration step, can all be performed in vapor phase and at an elevated temperature without any phase change between the steps. As a result, there can be substantial utility savings in comparison to a traditional hydrotreating process as described above. At column 16, lines 9–18 the patent discloses that:

> "Any adsorbent may be used in this embodiment as long as it is capable of selectively removing hydrogen sulfide and/or ammonia from the remaining constituents of the stream. The adsorbents which are particularly suitable in the process of this preferred embodiment of the present invention and which are capable of providing good hydrogen sulfide and/or ammonia removal at the high temperatures employed in the adsorption cycle are 4A zeolite molecular sieve and clinoptilolite."

U.S. Pat. No. 4,831,206 issued to Zarchy and U.S. Pat. No. 4,831,207 issued to O'Keefe et al provide similar disclosures with regard to the type of adsorbent suitable for adsorbing sulfur at high temperatures. U.S. Pat. No. 4,935,580 issued to Chao et al., and U.S. Pat. No. 4,964,889 issued to Chao, provide in-depth descriptions of certain clinoptilolite adsorbents useful in adsorption processes.

Apart from the above-cited patents relating to the adsorption of sulfur at high temperatures, it has been common in processes that disclose the removal of sulfur from hydrocarbon feedstreams to employ relatively low sulfur adsorption temperatures, e.g., below about 200° F. For example, note the following patents which relate to isomerization processes and disclose methods for the removal of sulfur compounds at low temperatures to prevent deactivation of the isomerization catalyst: U.S. Pat. Nos. 2,937,215 issued to Bleich et al; 2,951,888 issued to Carr; 3,069,349 issued to Meiners; 3,540,998 issued to Bercik et al; and 4,795,545 issued to Schmidt.

In natural gas processing, it is also often desirable to remove sulfur compounds from the feedstream. In many instances, it is not because there is a sulfur-sensitive processing step downstream of the sulfur removal step, but rather the sulfur removal must be done in order to satisfy some other requirements such as natural gas pipeline sulfur concentration limits. For example, note the following patents which disclose processes for the removal of sulfur from light hydrocarbon streams: U.S. Pat. Nos. 3,864,460 issued to Connell, 4,717,552 issued to Carnell et al, 4,830,733 and 4,830,744 issued to Nagji et al; and European Patent Application No. 89300959.7 published on Aug. 23, 1989. The above-described patents generally disclose an adsorption temperature for adsorbing sulfur of about ambient temperature.

The Zeolite 4A adsorbent described above for sulfur removal is particularly useful because it has high affinity for $H_2S$ and excludes hydrocarbons with four or more carbon atoms at ambient temperature, i.e., there is little co-adsorption of hydrocarbons. At ambient temperature, it is able to reduce the sulfur content in a hydrocarbon stream to very low concentrations with high capacity for $H_2S$, i.e., delta loading. However, at elevated temperatures, Zeolite 4A adsorbs a significant amount of hydrocarbons with four or more carbon atoms, therefore, there is more co-adsorption of hydrocarbons, lower capacity and less affinity for $H_2S$. Accordingly, there is a need for processes which use improved adsorbents for $H_2S$ adsorption which can be operated either at low temperatures, e.g., ambient, or at elevated temperatures, e.g., greater than about 200° F.

Furthermore, many hydrocarbon conversion processes such as paraffin isomerization processes are carried out in the presence of halides which act as activators for the hydrocarbon conversion. Note, for example, above-cited U.S. Pat. Nos. 2,937,215 and 3,069,349 which disclose the use of halide promoted catalysts. When chlorides are present, the use of certain adsorbents such as Zeolite 4A can be unsuitable due to chloride attack of the zeolite. Thus, processes are further sought for sulfur removal which use adsorbents that have improved resistance to chloride attack.

SUMMARY OF THE INVENTION

By the present invention processes are provided for separating hydrogen sulfide from a feedstream containing hydrogen sulfide and hydrocarbons by adsorption using clinoptilolite adsorbent containing cations having ionic radii of between about 1.10 and 1.40 Angstroms. By virtue of the present invention it is now possible to adsorb $H_2S$ even at a temperature above 200° F. from a feedstream which has a very low $H_2S$ partial pressure. The clinoptilolite adsorbent of the present invention has a high adsorption capacity for $H_2S$ which is believed to be due to its extraordinary affinity for $H_2S$ and its ability to effectively exclude n-butane at elevated temperatures. The processes of the present invention can provide substantially increased capacity for hydrogen sulfide as compared to processes which use other adsorbents such as Zeolite 4A. Moreover, the processes of the present invention are suitable for treating feedstreams that contain halides such as HCl or organic chlorides because the crystalline structure of the adsorbent of the present invention is surprisingly stable to chloride environments.

In one aspect of the invention there is provided a process for separating hydrogen sulfide from a feedstream containing hydrogen sulfide and hydrocarbons which comprises contacting the feedstream in an adsorbent bed with a clinoptilolite molecular sieve containing cations having ionic radii of from about 1.10 to 1.40 Angstroms in a concentration effective to cause hydrogen sulfide to be selectively adsorbed on the clinoptilolite molecular sieve, and withdrawing an effluent stream having a reduced amount of hydrogen sulfide relative to the feedstream.

In another aspect of the invention there is provided a process for separating hydrogen sulfide from a feedstream comprising hydrogen sulfide and hydrocarbons having from about 4 to 12 carbon atoms per molecular, comprising: (a) passing the feedstream at adsorption conditions to an adsorber bed containing a clinoptilolite molecular sieve containing cations having ionic radii of from about 1.10 to 1.40 Angstroms in a concentration effective to cause hydrogen sulfide to be selectively adsorbed on the clinoptilolite molecular sieve, and withdrawing an adsorption effluent stream having a reduced concentration of hydrogen sulfide relative to the feedstream; and (b) passing a purge gas through the adsorber bed at desorption conditions effective to cause hydrogen sulfide to be desorbed from the clinoptilolite molecular sieve, and withdrawing a desorption effluent stream having an increased concentration of hydrogen sulfide relative to the purge gas.

In a preferred aspect of the invention the adsorption effluent stream from the adsorber bed that has a reduced amount of hydrogen sulfide relative to the feedstream is passed to a hydrocarbon conversion reactor wherein the feedstream is converted to a hydrocarbon product. Typical examples of hydrocarbon conversion processes that utilize catalysts which are sulfur-sensitive are paraffin isomerization or reforming processes. Preferably, at least a portion of the effluent from the hydrocarbon conversion step is used as a purge gas to regenerate the adsorber bed.

DETAILED DESCRIPTION OF THE INVENTION

Figure 1:
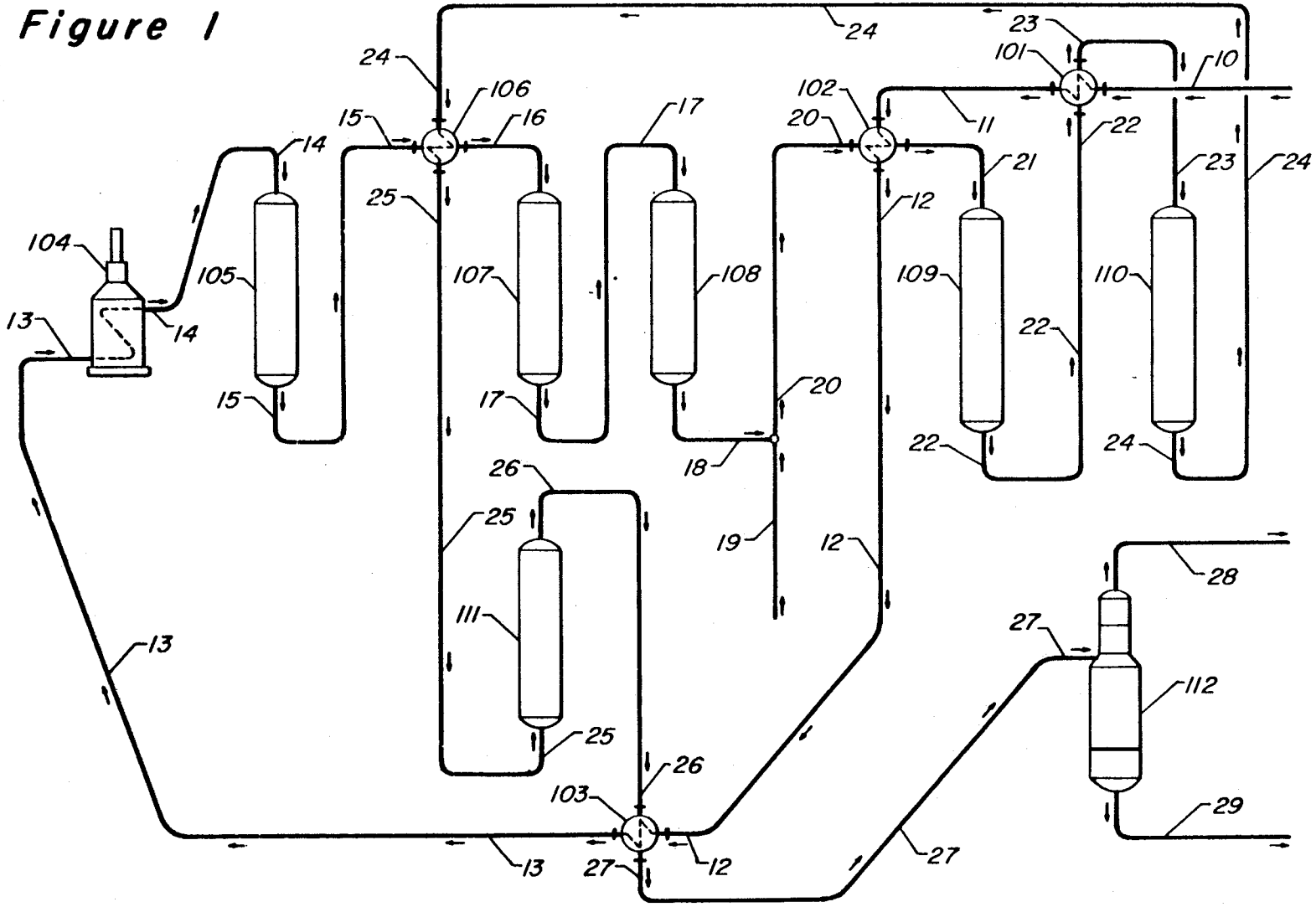
FIG. 1 illustrates a process flow diagram of a paraffin isomerization process in accordance with the present invention.

It is known that the pore size of many zeolites, and hence their ability to separate gaseous mixtures, can be varied by incorporating various metal cations into the zeolites, typically by ion-exchange or impregnation. For example U.S. Pat. No. 2,882,243 issued to Milton, describes the use of zeolite A having a silica/alumina ratio of $1.85 \pm 0.5$ and containing hydrogen, ammonium, alkali metal, alkaline earth metal or transition metal cations. The patent discloses that potassium A zeolite adsorbs water (approximately 3 Angstroms) and excludes hydrocarbons and alcohols, white calcium A zeolite adsorbs straight-chain hydrocarbons (approximately 5 Angstroms) but excludes branched-chain and aromatic hydrocarbons.

Thus potassium A is commonly referred to as having an effective pore diameter of 3 Angstroms and calcium A similarly is referred to as having an effective pore diameter of 5 Angstroms. The term "effective pore diameter" is used in order to functionally define the pore size of a molecular sieve in terms of what molecules it can adsorb rather than actual dimensions which are often irregular and non-circular, e.g., elliptical. D. W. Breck, in *Zeolite Molecular Sieves,* John Wiley and Sons (1974), hereby incorporated by reference, describes effective pore diameters at pages 633 to 641.

In most cases, the changes in the pore size of zeolites following ion-exchange are consistent with a physical blocking of the pore opening by the cation introduced. In general, in any given zeolite, the larger the radius of the ion introduced, the smaller the effective pore diameter of the treated zeolite (for example, the pore diameter of potassium A zeolite is smaller than that of calcium A zeolite), as measured by the size of the molecules which can be adsorbed into the zeolite.

Such is not the case, however, with clinoptilolites which demonstrate an unpredictable relationship that is not a simple function of the ionic radius of the cations introduced, i.e., pore blocking. For example, applicants have found that unlike the above-described calcium and potassium ion-exchanged forms of zeolite A, clinoptilolite produces the opposite effect with these two cations. That is, potassium cations, which are larger than calcium cations, provide a clinoptilolite having a larger effective pore diameter than calcium ion-exchanged clinoptilolite. Calcium has an ionic radius of 0.99 Å versus 1.33 Å for potassium. See F. A. Cotton, G. Wilkinson, *Advanced Inorganic Chemistry,* Interscience Publishers (1980) or the *Handbook of Chemistry and Physics,* 56 Edition, CRC Press (1975) at pg. F-209, said references hereby incorporated by reference. In fact, applicants have found that a calcium ion-exchanged clinoptilolite with a calcium content equivalent to about 90% of its ion-exchange capacity defined by its aluminum content essentially excludes both hydrogen sulfide and n-butane. On the other hand, a potassium ion-exchanged clinoptilolite with a potassium content equivalent to about 95% of its ion-exchange capacity adsorbs hydrogen sulfide rapidly but substantially excludes n-butane. Thus, the clinoptilolite containing the cation with the larger ionic radius, i.e., potassium, has a larger pore than the clinoptilolite containing the cation with the smaller ionic radius, i.e., calcium.

The clinoptilolites used in the process of the present invention may be natural or synthetic clinoptilolites. Natural clinoptilolites are preferred because they are currently readily available in commercial quantities. However, natural clinoptilolites are variable in composition and chemical analysis shows that the cations in clinoptilolite samples from various mines and even within a single deposit can vary widely. Moreover, natural clinoptilolites frequently contain substantial amounts of impurities, especially soluble silicates, which may alter the adsorption properties in the aggregation or pelletization of the clinoptilolite (discussed in more detail below), or may cause undesirable side effects which may inhibit practicing this invention. As an example of the compositional variations in natural clinoptilolites, the following Table 1 sets forth the chemical analysis of several clinoptilolites ore samples.

TABLE 1

| Ore No. | 1 | 2 | 3 | 4 | 5 |
|---|---|---|---|---|---|
| Source No. | 1 | 2 | 3 | 2 | 1 |
| Wt. % dry basis | | | | | |
| $SiO_2$ | 76.37 | 76.02 | 75.24 | 76.67 | 76.15 |
| $Al_2O_3$ | 12.74 | 13.22 | 12.62 | 13.95 | 12.90 |
| MgO | 0.55 | 0.77 | 2.12 | 0.76 | 0.33 |
| CaO | 0.55 | 2.19 | 2.72 | 2.27 | 1.04 |
| $Na_2O$ | 3.86 | 3.72 | 2.25 | 3.26 | 4.09 |
| $K_2O$ | 4.21 | 2.11 | 2.17 | 1.93 | 4.08 |
| Other* | 1.72 | 1.98 | 2.88 | 1.16 | 1.41 |
| | 100.00 | 100.00 | 100.00 | 100.00 | 100.00 |
| Cation Concentration mmol/gm | | | | | |
| Si | 12.73 | 12.67 | 12.54 | 12.78 | 12.69 |
| Al | 2.50 | 2.59 | 2.47 | 2.74 | 2.53 |
| Mg | 0.14 | 0.19 | 0.53 | 0.19 | 0.08 |
| Ca | 0.10 | 0.39 | 0.49 | 0.41 | 0.19 |
| Na | 1.25 | 1.20 | 0.73 | 1.05 | 1.32 |
| K | 0.89 | 0.45 | 0.46 | 0.41 | 0.87 |

*Includes the following oxides: $Fe_2O_3$, SrO, BaO

It can be seen from Table 1 that the concentrations of the various cations of the ore samples can vary quite substantially, especially when considered in view of the total theoretical ion-exchange capacity based on aluminum content. Note, for instance, the magnesium content which varies from about 6.4 equivalent percent in Ore No. 5 to about 42.6 equivalent percent in Ore No. 3, e.g., for Ore No. 5, using the cation concentrations, $Mg \times 2/Al \times 100 = \%$, $0.081 \times 2/2.530 \times 100 = 6.4\%$. Similarly, the potassium content varies from 15.0 equivalent percent in Ore No. 4 to 35.6 equivalent percent in Ore No. 1. With respect to cations present in relatively small amounts such as, barium or strontium, the variations are generally not significant.

It is important to note that the cation content based upon the theoretical ion-exchange capacity of the aluminum content is often not truly indicative of the ion-exchangeable cation content. Natural zeolites often contain non-zeolite minerals which contain unexchangeable cations. Hence, while the non-exchangeable cations appear in the chemical analysis, they do not influence the adsorption properties in the same way that the ion-exchangeable cations do. For example, an extensive ion-exchange can typically bring the particular cation to the level of about 85–95% of its ion-exchange capacity but residual Na, K, Mg, Ca cations nonetheless typically appear in the range of 5–15% of the ion-exchange capacity.

Since the amount of non-exchangeable cations can vary, a simple definition of cation content that does not distinguish between exchangeable and non-exchangeable cations may not adequately characterize the clinoptilolite for purposes of the present invention. Accordingly, applicants have defined the cation concentration of the clinoptilolite in terms of the equivalents percent of ion-exchangeable cations in the clinoptilolite. The amount of ion-exchangeable cation is determined by thoroughly ion-exchanging the clinoptilolite by continuous purging in an ion-exchange vessel with a solution having a particular cation in a concentration of at least 1 mol/liter and in an amount of at least 10-fold the total ion-exchange capacity and then analyzing the clinoptilolite for the remaining cations other than the particular cations used in the ion-exchange. In accordance with the definition of the present invention, the amount of other cations remaining are assigned a zero baseline. For example, the procedure for determining the equivalent percent of ion-exchangeable potassium cations of an ore having a potassium content of 10 equivalent percent of the total theoretical ion-exchange capacity based on aluminum content is as follows; the ore is ion-exchanged with a solution having a 20-fold excess of sodium cations in concentration of 2 mol/liter. An analysis of the sodium-exchanged clinoptilolite shows 6 equivalent percent of potassium cations remaining. Therefore, 6 equivalent percent are not ion-exchangeable and 4 equivalent percent are ion-exchangeable potassium cations. For cation species present in small amounts in the natural clinoptilolites, e.g., barium and strontium, the amount of non-exchangeable cations of the particular species is generally not significant.

Often, due to the above-described compositional variations, it is desirable to treat the natural clinoptilolite with a thorough ion-exchange to cause a uniform starting material. For this initial ion-exchange, it is important to use a cation of reasonably high ion-exchange selectivity so it can effectively displace a substantial portion of the variety of cations originally existing in the natural zeolite. However, it is also important to not use a cation of overly high selectivity, otherwise it would make further tailoring of the adsorption properties of the clinoptilolite by ion-exchange difficult. The cations suitable to provide compositional uniformity in accordance with the present invention include sodium, potassium, calcium, lithium, magnesium, strontium, zinc, copper, cobalt, and manganese. It is often economically advantageous, and preferred, to use sodium or potassium for this purpose. The ion-exchanged clinoptilolite can then be further ion-exchanged with other cations, e.g., barium cations, to establish the desired level. It is, of course, possible to ion-exchange the clinoptilolite directly with cations other than set forth above, e.g., barium cations, without an initial ion-exchange.

Applicants have found that the clinoptilolite of the present invention must have a concentration of cations effective to cause hydrogen sulfide to be selectively adsorbed on the clinoptilolite molecular sieve. It is to be understood that the cations which are suitable for use in accordance with the present invention are those which have an ionic radius of from about 1.10 to 1.40 Angstroms in a stable oxidation state. For purposes of the present invention, a cation is in a stable condition state when it has a low propensity to oxidize in air at atmospheric conditions. Note, for instance, that calcium with a +1 charge has an ionic radius of 1.18 Å which is within the above-stated range, however, calcium is unstable in air at atmospheric conditions and readily oxidizes to a +2 charge whereupon the ionic radius becomes 0.99 Å which is outside the above-stated range. (Note the *Handbook of Chemistry and Physics*, supra.) The cations for use in accordance with the present invention are preferably selected from silver, gold, barium, mercury, potassium, lead and strontium, and more preferably selected from barium, potassium and strontium. A most preferred cation for use in accordance with the present invention is barium. Often the clinoptilolite adsorbent of the present invention will contain more than one of the above cations. The precise content of said cations having an ionic radii between about 1.10 to 1.40 Angstroms will be dependent on the content of other cations present in the clinoptilolite, but will typically be at least 5 equivalent percent of the ion-exchangeable cations based on the aluminum content. It is preferred that said cation content be at least about 50 equivalent percent and more preferably from about 60 to 95.

When barium cations are predominantly employed, the concentration is preferably from about 20 to 95 and more preferably from about 50 to 95 equivalent percent of the ion-exchangeable cations. When potassium cations are predominantly employed, the concentration is preferably from about 20 to 95 and more preferably from about 50 to 95 equivalent percent of the ion-exchangeable cations. When strontium cations are predominantly employed, the concentration is preferably from about 20 to 95 and more preferably from about 50 to 95 equivalent percent of the ion-exchangeable cation.

In addition to the above-described cations, other cations such as sodium, lithium, calcium, magnesium, zinc, copper, cobalt, iron, manganese and mixtures thereof can also be ion-exchanged into the clinoptilolite in order to produce enhanced adsorption characteristics. When such additional cations are present or ion-exchanging is used to enhance the performance for the separation of hydrogen sulfide and hydrocarbons, it is preferred that they comprise not more than about 95 equivalent percent, and more preferred that they comprise from about 1 to 30 equivalent percent.

Since clinoptilolite is a natural material, the particle sizes of the commercial product varies, and the particle size of the clinoptilolite may affect the speed and completeness of the ion-exchange reaction. In general, it is recommended that the particle size of the clinoptilolite used in the ion-exchange reaction be not greater than about 8 U.S. Mesh. Although the particle sizes of many commercial clinoptilolites are greater, their particle sizes are readily reduced by grinding or other techniques which will be familiar to those skilled in the ion-exchange of molecular sieves.

Techniques for the ion-exchange of zeolites such as clinoptilolite are well known to those skilled in the molecular sieve art, and hence will not be described in detail herein. When an ion-exchange is to be performed, the cation is conveniently present in the solution in the form of its chloride. To secure maximum replacement of the original clinoptilolite cations, it is preferred that the ion-exchange be conducted using a solution containing a quantity of the cation to be introduced which is from about 2 to about 100 times the ion-exchange capacity of the clinoptilolite. Typically the ion-exchange solution will contain from about 0.1 to about 5 moles per liter of the cation, and will be contacted with the original clinoptilolite for at least about 1 hour in a column, with solution flowing once through. The ion-exchange may be conducted at ambient temperature, although in many cases carrying out the ion-exchange at elevated temperatures, usually less than 100° C., accelerates the ion-exchange process.

As hereinbefore noted, it is typically found that, even after the most exhaustive ion-exchange, a proportion, i.e., from about 5 to 15 weight percent, of the original clinoptilolite cations cannot be replaced by other cations. However, the presence of this small proportion of the original clinoptilolite cations does not materially interfere with the use of the ion-exchanged clinoptilolites in the process of the present invention.

When the clinoptilolites of the present invention are to be used in industrial adsorbers, sometime it is advantageous to pulverize the ore first then reform it into aggregates to control the macropore diffusion. Those skilled in molecular sieve technology are aware of conventional techniques for aggregating molecular sieves; such techniques usually involve mixing the molecular sieve with a binder, which is typically a clay, forming the mixture into a aggregate, typically by extrusion or bead formation, and heating the formed molecular sieve/clay mixture to a temperature of about 600°-700° C. to convert the green aggregate into one which is resistant to crushing.

The binders used to aggregate the clinoptilolites may include clays, silicas, aluminas, metal oxides and mixtures thereof. In addition, the clinoptilolites may be formed with materials such as silica, alumina, silica-alumina, silica-magnesia, silica-zirconia, silica-thoria, silica-berylia, and silica-titania, as well as ternary compositions such as silica-alumina-thoria, silica-alumina-zirconia and clays present as binders. The relative proportions of the above materials and the clinoptilolites may vary widely with the clinoptilolite content ranging between about 1 and about 99, preferably between about 60 to 95, percent by weight of the composite. Where the clinoptilolite is to be formed into aggregates prior to use, such aggregates are desirably about 1 to about 4 mm. in diameter.

Before being used in the processes of the present invention, the clinoptilolites should be activated by calcining, i.e., heating. If the clinoptilolite is aggregated as discussed above, the heat required for aggregation will normally be sufficient to effect activation also, so that no further heating is required. If, however, the clinoptilolite is not to be aggregated, a separate activation step will usually be required. Moreover, if the ore is used directly or ion-exchange is conducted after the aggregation, a separated activation step will be required. Barium clinoptilolite can be activated by heating in air, inert atmosphere, or vacuum to a temperature and for a time sufficient to cause the clinoptilolite to become activated. The term "activated" is used herein to describe an adsorbent having a reduced water content relative to being in equilibrium with atmospheric air. Typical activation conditions include a temperature of 350° to 700° C. and a time of 30 minutes to 20 hours which is sufficient to reduce the water content of clinoptilolite to about 0.2 to 2 wt. %. Preferably, the clinoptilolite is activated by heating in an air or nitrogen purge stream or in vacuum at approximately 300° to 650° C. for about 1 hour. The temperature needed for activation of any particular specimen of clinoptilolite can be easily determined by routine empirical tests where typical adsorption properties such as absolute loadings or adsorption rates are measured for samples activated at various temperatures.

Although ion-exchange of clinoptilolite does produce a modified clinoptilolite having a consistent pore size, the resulting effective pore diameter depends not only upon the cation(s) exchanged but also upon the thermal treatment of the product following ion-exchanged. In general, there is a tendency for the pore size of the clinoptilolites of this invention to decrease with exposure to increasing temperature. Accordingly, in selecting an activation temperature for the clinoptilolites, care should be taken not to heat the clinoptilolites of the present invention to temperatures for which cause reductions in pore size so severe as to adversely affect the performance of the clinoptilolites in the process of the present invention, i.e., higher than 700° C.

The clinoptilolite molecular sieves of the present invention are useful in adsorption processes for the removal of hydrogen sulfide from hydrocarbon feedstreams. The amount of hydrogen sulfide present in the feedstream is not critical to performing the process and can be as low as about 3 ppmv or as high as about 1,000 ppmv, for example. Typically, the hydrogen sulfide content will be in the range of from about 100 to 500 ppmv.

The type and concentration of hydrocarbons present in the feedstream are not critical to performing the process but can influence the performance somewhat. Preferably, the hydrocarbons will be present in the carbon range of from about 4 to about 12 carbon atoms per molecule. Hydrocarbons in the methane through propane carbon range can also be processed in accordance with the present invention, but there may be some co-adsorption of the hydrocarbons on the molecular sieve which could inhibit the ability to adsorb hydrogen sulfide.

Occasionally, the feedstream will consist essentially of hydrocarbons and hydrogen sulfide, with a minor amount of other impurities such as water, carbon oxides, nitrogen, etc. More typically, the feedstream will contain a substantial quantity of other components as well. For example, in many hydrocarbon processing operations there is often a substantial quantity of hydrogen present in the feedstream, e.g., 50 mol. % or more. In some instances there may be other components such as nitrogen or steam present in the feedstream. When impurities such as carbon oxides or ammonia are present, it is important to note that these impurities may also be adsorbed along with hydrogen sulfide.

The present invention can be performed by virtually any known adsorption cycle such as pressure swing, thermal swing, displacement purge or non-adsorbable purge (i.e., partial pressure reduction). Such adsorption processes are well known to those skilled in the art and need not be disclosed in detail herein. However, the following publication, hereby incorporated by reference, provides a summary of the various types of adsorbent regeneration processes. Lukchis, "Adsorption System Part 3 Adsorbent Regeneration," *Chemical Engineering*, pages 83–90, Aug. 6, 1973.

Since hydrogen sulfide is often present in the feedstream in relatively small quantities a thermal swing adsorption cycle is preferred in accordance with one aspect of the present invention. Thus, in a preferred aspect of the present invention, the feedstream is contacted with a clinoptilolite molecular sieve that has a concentration of cations having ionic radii of from about 1.10 to 1.40 Å and at conditions effective to cause the hydrogen sulfide to be selectively adsorbed. Preferred adsorption conditions include a temperature of from about 200° to 600° F. When the adsorption process of the present invention is integrated with another process such as a hydrocarbon conversion process, preferred ranges may be narrower depending on the process, e.g., from about 200° to 400° F. for isomerization, and from about 400° to 600° F. for reforming. When a thermal swing cycle is employed, the adsorption pressure is not critical. Typical pressures during the adsorption step will range between about 50 to 500 psia although pressures outside this range may also be suitable. The adsorption step during a thermal swing cycle is preferably continued for a time of from about 0.5–6 hours. Once the adsorption step of the thermal swing cycle is terminated, the adsorber bed is preferably regenerated by passing a purge gas therethrough at an elevated temperature relative to the adsorption temperature and sufficient to cause hydrogen sulfide to be desorbed from the molecular sieve. Preferred desorption conditions include a temperature of from 300° to 700° F. When integrated with an isomerization process, the preferred desorption temperature range is from about 300° to 600° F. and when integrated with a reforming process, the preferred desorption temperature range is from about 500° to 700° F. Thus, one skilled in the art can select suitable adsorption and desorption temperatures depending upon the temperature of the process to be integrated therewith.

Another preferred adsorption cycle is a pressure swing cycle wherein adsorption is conducted at an elevated pressure, preferably at least 50 psia, more preferably from about 100 to 500 psia, and desorption is conducted at a pressure lower than the adsorption pressure, preferably from about 1 to 100 psia. Typically, a purge step is included to assist the desorption, either at or above the adsorption temperature.

An important feature of the present invention is that the adsorption can be conducted at an elevated temperature, e.g., greater than about 200° F. Thus, it is possible to efficiently integrate the adsorption process with other high temperature processes such as hydrocarbon conversion processes that utilize a catalyst that is sulfur-sensitive. Thus, in a preferred aspect of the present invention, the process includes a step of passing at least a portion of the sulfur-depleted adsorption effluent from the clinoptilolite adsorbent bed to a hydrocarbon conversion zone containing a catalyst that is sulfur-sensitive and withdrawing a reactor effluent stream comprising reactor hydrocarbon product. Preferably, at least a portion of the reactor effluent stream is used as the purge gas for desorbing the clinoptilolite adsorbent bed. Thus, in essence, the sulfur is merely by-passed around the sulfur-sensitive processing step. Because the entire process can be conducted in the vapor phase, substantial energy savings can be achieved over a process that requires a condensation in reheating of the various process streams.

One hydrocarbon conversion process that utilizes a sulfur-sensitive catalyst is an isomerization process wherein normal paraffin hydrocarbons having from about 4 to 6 carbon atoms per molecule are isomerized in order to provide a reactor hydrocarbon product that comprises at least one of isobutane, isopentane, 2-methylpentane, 3-methylpentane, 2,2,-dimethylbutane and 2,3-dimethylbutane. Such processes may or may not occur in a halide environment. When the catalyst is halide activated, e.g., with organic chlorides or HCl, the catalyst usually comprises a noble metal such as platinum or palladium on a support material such as alumina. Typical catalysts that do not require chloride activation for isomerization are those that contain a noble metal such as platinum or palladium on a mordenite support, for example. The details concerning the process parameters relating to the isomerization of normal paraffins such as the temperatures, pressures, weight hourly space velocities as well as the catalyst type and composition are well known to those skilled in the art and need not be further disclosed herein.

Another hydrocarbon conversion process which utilizes a sulfur-sensitive catalyst is a reforming process wherein hydrocarbons having from about 6 to 10 carbon atoms per molecule are converted into a reactor hydrocarbon product which typically has an increased concentration of aromatic hydrocarbons relative to the feedstream. It is important to note that the reforming process involves other reactions in addition to forming aromatic hydrocarbons such as isomerization and dehydrocyclodimerization, all of which function to increase the octane value of the product which is the main purpose of the reforming operation. Reforming reactions can be conducted in a halide environment where a reforming catalyst comprising a noble metal on an alumina support is employed. The precise conditions relating to the reforming reaction such as temperatures, pressures, weight hourly space velocities, the type of catalyst and the like are well known to those skilled in the art and need not be further disclosed herein.

In many hydrocarbon conversion processes, such as paraffin isomerization and reforming processes disclosed above, as well as other processes such as hydrofluoric acid catalyzed alkylation, a primary function is to provide blending components which are suitable for use as a motor fuel, e.g., gasoline. Thus, in accordance with the present invention, the process further comprises admixing at least a portion of the reactor hydrocarbon product with other gasoline blending components to form a motor fuel such as gasoline.

Often the raw feed material which is intended to be processed in accordance with the present invention will contain sulfur compounds other than hydrogen sulfide such as alkyl mercaptans, sulfides and thiophenes. Therefore, in some instances, it will be necessary to convert the organic sulfur compounds to hydrogen sulfide before treating in accordance with the present invention. This can be readily accomplished by passing the raw feed over a hydrotreating catalyst at effective conditions to convert the organic sulfur compounds to hydrogen sulfide. As noted above, hydrotreating, i.e., hydrodesulfurization, is well known to those skilled in the art. Accordingly, the specific details concerning the reaction temperature, pressure, weight hourly space velocity and the catalyst need not be disclosed herein. However, it can be advantageous in accordance with the present invention to employ operational parameters that are compatible with the adsorption cycle in any other hydrocarbon conversion process integrated with the adsorption cycle.

The following examples are provided for illustrative purposes and are not intended to limit the scope of the claims which are set forth below.

EXAMPLE I—PREPARATION OF ION-EXCHANGED MOLECULAR SIEVE SAMPLES

Sample 1—4A-50

Sample 1 is a commercially-available Type A zeolite synthesized with sodium cations to provide an effective pore diameter of about 4 Angstroms. The sample was obtained from UOP, Des Plaines, Ill. Sample 1 was used as a standard for comparison against the samples hereinafter described.

Sample 2—A. W. Clino

Sample 2 is an acid washed (leached) clinoptilolite. It was prepared by placing 2000 gm of 8×12 meshed ore (obtained from source 1) in a glass column. The glass column was maintained at 90° C. with a heating tape. About 20 liters 2N HCl was maintained at 90° C. in a glass flask by a heating mantle. The HCl was circulated through the column recycling at a flow rate about 300 ml/min. The acid leaching process was continued for about 40 hours. The product was washed with about 26 liter of water at 90° C. in a period of two hours. The chemical analysis of this sample is given in Table 2.

Sample 3—K-Mordenite

Sample No. 3 is a mordenite type zeolitic molecular sieve that was ion-exchanged with potassium cations. The K-Mordenite was prepared as follows: A commercially produced sodium mordenite sample in the form of ⅛" extrudates was obtained from UOP. 200 gm of this sample was loaded into a glass column having dimensions of about 4 ft. long, 1" in diameter and heated with a heating tape to about 90° C. About 20 liters 0.26N KCl solution was pumped through the column in a period of 16 hours. The product was washed by pumping through the column 10 liters of 90° C. water to remove excess potassium salt. The chemical analysis of this sample is given in Table 2.

Sample 4—Acid Washed K-Clinoptilolite

Sample 4 is an acid washed potassium-exchanged clinoptilolite. To prepare acid washed K-clinoptilolite, 400 mg of 30×50 meshed ore (obtained from source 1) were placed in a glass column and washed by recycling 5 liters 2N HCl at room temperature through the column for 2 hours. Half of the acid washed ore was then ion-exchanged with 1M KCl solution at 90° C. About 10 liters KCl solution equivalent to 20 times of the total ion-exchange capacity of the sample was pumped through the column in a period of 16 hours. The zeolite was then washed by pumping 10 liter 0.01M KCl solution through the column. The chemical analysis of this sample is given in Table 2.

Sample 5—Ba-Clino

Sample No. 5 is a barium ion-exchanged clinoptilolite that was prepared as follows: 2000 gm 8×12 meshed ore (obtained from source 1) were placed in a 3" diameter by 4 foot long glass column. The glass column was maintained at 90° C. with a heating tape. 33 liters of 1.2M $BaCl_2$ solution was pumped through the column in a period of 16 hours. The zeolite was then washed with 10 liters of distilled water at 90° C. by pumping it through the column in a period of 2 hours. The results of chemical analysis of this ion-exchanged sample is given in Table 2.

Sample 6—Ba-Clino AW

Sample 6 is an acid washed clinoptilolite that was additionally barium ion-exchanged and prepared as follows: About 60 lb of 8×12 meshed ore (from source 1) was loaded into a stream jacketed stainless steel column. It was washed with a mixture solution of 0.3N HCl and 2N NaCl at 60° C. The solution to zeolite ratio was about 25 ml/gm of zeolite. The solution was recycled at a rate of about 18 gal/min for 2 hours. After the acid washing was completed, the column was drained and the ore sample was washed with approximately 10 bed volumes of a 0.01N NaCl solution at 90° C. The acid washed sample was further ion-exchanged with 2N $BaCl_2$ at a pH of 8 at 90° C. The total $BaCl_2$ content in the solution was about 4 times the total ion-exchange capacity of the zeolite sample. The solution was pumped through the column in a period of 6 hours. The ion-exchanged sample was then washed with approximately 10 bed volumes of a 0.01N $BaCl_2$ solution at about 90° C. The washed product was then dried and calcined at 550° C. The result of chemical analysis of the sample is given in Table 2.

Sample 7—Clinoptilolite Ore from Source 1

Sample 7 is an ore sample (obtained from source 1) in 8×12 meshed form. The chemical analysis of this sample is given in Table 1 as Ore No. 5.

Sample 8—Na-Clinoptilolite

Sample 8 is a sodium-exchanged clinoptilolite. The Na-clinoptilolite was prepared as in Sample 5, except that an NaCl solution of 2N was used as the total amount of NaCl used was equal to about 20 times the total ion-exchange capacity of the sample. The chemical analysis of the sample is given in Table 2.

Sample 9—Ca-Clinoptilolite

Sample 9 is a calcium-exchanged clinoptilolite. The Ca-clinoptilolite sample was prepared as in Sample 3, except that the solution used was 0.26M $CaCl_2$, the volume of solution used was 10 liters, and the temperature of the ion-exchange was 80° C. The chemical analysis of this sample is given in Table 2.

Sample 10—Sr-Clinoptilolite

Sample 10 is a strontium-exchanged clinoptilolite. The Sr-clinoptilolite was prepared as in Sample 9 except that the solution used was 0.25M $SrCl_2$. The chemical analysis of this sample is given in Table 2.

Samples 11—HCl Treatment of Clinoptilolite Samples

Samples 2, 3, 4 and 6 were vacuum activated at 400° C. then exposed to an atmosphere containing 20 torr HCl for a time period of 3 hrs. The treatment resulted in an HCl loading of 5 wt. %. The chlorided treated samples were renamed Samples 11–14, respectively.

TABLE 2

| | Sample Analysis | | | | | | | | |
|---|---|---|---|---|---|---|---|---|---|
| Sample No. | 1 | 2 | 3 | 4 | 5 | 6 | 8 | 9 | 10 |
| Wt. % dry basis | | | | | | | | | |
| $SiO_2$ | 43.9 | 86.9 | 61.0 | 77.1 | 69.5 | 73.1 | 76.9 | 77.9 | 77.7 |
| $Al_2O_3$ | 35.9 | 11.8 | 30.3 | 12.3 | 11.3 | 11.6 | 12.8 | 12.8 | 12.9 |
| BaO | — | — | — | — | 16.2 | 12.6 | — | — | — |
| MgO | — | 0.12 | — | 0.22 | 0.32 | 0.26 | 0.45 | 0.22 | — |
| CaO | — | 0.26 | — | 0.14 | 0.87 | 0.22 | 1.0 | 6.57 | 0.37 |
| $Na_2O$ | 20.2 | 0.38 | — | 0.26 | 0.27 | 0.42 | 6.9 | 0.26 | 0.37 |
| $K_2O$ | — | 0.48 | 8.7 | 9.2 | 0.70 | 1.16 | 1.0 | 0.95 | 1.05 |
| $Fe_2O_3$ | — | 0.09 | — | 0.80 | 0.85 | 0.71 | 0.92 | 0.81 | — |
| SrO | — | — | — | — | — | — | — | — | 7.53 |
| Total | 100.00 | 100.00 | 100.00 | 100.00 | 100.00 | 100.00 | 100.00 | 100.00 | 100.00 |
| Cation Concentration mmol/gm | | | | | | | | | |
| Si | 5.67 | 14.6 | | 12.8 | 11.6 | 12.3 | 12.8 | 13.1 | 12.4 |
| Al | 5.45 | 23.3 | | 2.4 | 2.2 | 2.3 | 2.5 | 2.6 | 2.4 |
| Ba | — | — | | — | 1.1 | 0.83 | 0 | — | — |
| Mg | — | 0.03 | | 0.05 | 0.08 | 0.07 | 0.11 | 0.06 | — |
| Ca | — | 0.05 | | 0.02 | 0.16 | 0.04 | 0.18 | 1.17 | 0.06 |
| Na | 5.07 | 0.125 | | 0.08 | 0.09 | 0.13 | 1.94 | 0.09 | 0.11 |
| K | — | 0.10 | | 1.93 | 0.15 | 0.24 | 0.21 | 0.2 | 0.22 |
| Sr | 0 | 0 | | 0 | 0 | 0 | — | — | 0.7 |

EXAMPLE II—ADSORBENT SCREENING FOR HYDROGEN SULFIDE ADSORPTION

A testing apparatus comprising an adsorber bed having dimensions of about ⅛" diameter by 4" and which contained approximately 0.1 grams of adsorbent was used to screen adsorbent materials for suitability in accordance with the present invention. The conditions included an adsorption pressure of about 350 psig at adsorption temperatures of 302°, 350° and 425° F. with a desorption temperature of about 500° F. The analytical unit comprised a Perkin Elmer 900 gas chromatograph (GC) with a Flame Photometric Detector (FPD) for sulfur detection. Two high temperature, high pressure valves were contained in the valve manifold of the GC. A first valve switched the flow direction such that desorption was countercurrent to adsorption. A second valve was used to load a sample loop for the FPD. Two sequencing timers were used to control the unit. One timer switched the sampling valve every 30 seconds. The other timer controlled the GPC program and switched the flow valve. The GC program maintained the oven at the adsorption temperature for the adsorption step then, the program ramped the oven temperature up to the desorption temperature at 20° C./minute, maintained the desorption temperature for the desorption step, then cooled the oven down to adsorption temperature. The adsorption time and the heat up/desorption/cool down times were equal and were long enough to allow for breakthrough, i.e., elution, of the $H_2S$ during the adsorption step. The feed flow rate during the adsorption step was about 30 cc per minute and had a composition of 770 ppmv $H_2S$ in He. The capacity, in weight percent of the adsorbent per cycle, i.e., grams of $H_2S$ per 100 grams of adsorbent per cycle, was determined as follows:

$$\Delta W = \frac{100\, n\, C_{H2S}\, M_{H2S}\, t_b}{W_{ads}}$$

where;

$\Delta W$=delta loading (g/100 g)

n=molar flow rate (gmol/min)

$C_{H2S}$=$H_2S$ concentration (mole $H_2S$/mole gas)

$M_{H2S}$=molecular weight of $H_2S$ (g/gmol)

$t_b$=breakthrough time (minutes)

$W_{ads}$=weight of adsorbent (g)

The data presented in Table 3 below sets forth the results of the adsorbent screening.

TABLE 3

| | Adsorbent Screening | | |
|---|---|---|---|
| | Adsorption Capacity, $gH_2S$/100 g ads. | | |
| Sample | 302° F. | 350° F. | 425° F. |
| 1 | 0.46 | 0.27 | 0.12 |
| 2 | 0.39 | | |
| 3 | 0.45 | 0.28 | |
| 4 | 1.20 | | |
| 6 | 1.87 | | 0.37 |
| 7 | 0.28 | | |
| 8 | 0.05 | | |
| 9 | 0.03 | | |
| 10 | 0.55 | | |
| 11 | 0.35 | | |
| 12 | 0.25 | 0.18 | |
| 13 | 0.63 | | |
| 14 | 1.11 | | |

The screening results demonstrate the enhanced results that can be obtained with the clinoptilolite adsorbents of the present invention. The data at 302° F. demonstrate that Samples 4 (potassium), 6 (barium), and 10 (strontium) provide enhanced capacity for $H_2S$ as compared to Zeolite 4A (Sample 1). The percent increase in $H_2S$ capacity for Samples 4, 6 and 10 was 160%, 306% and 20%, respectively. The ionic radii of the potassium, barium and strontium cations is 1.33, 1.34 and 1.12 Angstroms, respectively. In contrast, Samples 8 (sodium) and 9 (calcium), which have ionic radii of 0.97 and 0.99 Angstroms, respectively, had less capacity than 4A. Furthermore, Samples 2 (acid washed) and 7 (ore Sample 5) had less capacity than 4A. Thus, the data shows, quite unexpectedly, that only the clinoptilolite samples that contain a sufficient quantity of cations having ionic radii between about 1.10 and 1.40 Angstroms are suitable for use in accordance with this invention.

It can be seen from the data relating to Sample 3 in Table 3 that potassium exchange was not effective for enhancing capacity when using a different zeolite, i.e., mordenite. Sample 3 performed essentially the same as Sample 1 at both 302° and 350° F.

At 425° F., Sample 6 demonstrates an improvement in $H_2S$ capacity over Zeolite 4A of about 208%. See Table 3, the data show that enhanced results of the present invention can be obtained over a wide temperature range.

Table 3 further shows that with chloride loaded samples, the results were consistent, that is Samples 13 (potassium) and 14 (barium) had substantially higher capacities then Samples 11 (ore Sample 5) and 12 (mordenite). This data approximates what would be expected in a halide environment, such as during a chloride activated isomerization reaction.

Samples 1 and 6 were further tested at various adsorption and desorption temperatures as shown in Table 4 below. In all cases, the performance, i.e., capacity, of Sample 6 was substantially enhanced over Sample 1.

TABLE 4

| Adsorption Temp. (°F.) | Desorption Temp. (°F.) | Delta Loading (g/100 g) Ba-Clino (#6) | 4A-50 (#1) |
|---|---|---|---|
| 302 | 500 | 1.87 | 0.46 |
| 392 | 590 | 1.60 | 0.21 |
| 428 | 626 | 1.52 | 0.18 |
| 446 | 644 | 1.48 | 0.17 |
| 464 | 662 | 1.39 | 0.16 |
| 482 | 680 | 1.35 | 0.14 |
| 500 | 698 | 0.71 | — |

EXAMPLE III—PILOT PLANT TESTING

A hydrocarbon feed containing 600 ppmw of sulfur as diethyl sulfide is to be isomerized. A feed quantity of 40 cc/min at a density of 0.65 g/cc (equivalent to 26 g/min) is introduced into a hydrotreating bed loaded with 446 grams of 0.5% Pt on mordenite hydrotreating catalyst, yielding a weight hourly space velocity (WHSV) of 3.6 for the hydrotreating reaction.

The stream, now containing hydrogen sulfide is then fed into an adsorber loaded with from about 450 to 550 grams of the adsorbent sample depending upon its density. A highly sensitive gas chromatograph, such as described in Example II, capable of resolving sulfur to below 0.1 ppmv is utilized to monitor the path of sulfur in the system. Sample taps are placed on the inlet and the exit of the adsorber beds.

The stream then enters an isomerization reactor after being heated to a temperature of 500° F. The isomerization reactor contains 945 grams of a mordenite based isomerization catalyst from UOP, Des Plaines, Ill., which results in a WHSV of 1.65 weight of feed/weight of catalyst per hour. The isomerate leaving the reactor at a temperature of 500° F. then enters the desorption bed.

The system parameters are as follows:

| | |
|---|---|
| System pressure | 350 psig |
| Hydrotreating temp | 550° F. |

-continued

| | |
|---|---|
| Adsorption temp | 425° F. |
| Desorption temp | 500° F. |
| $H_2$/Hydrocarbon (mole basis) | 1.0 |
| Total cycle time (ads + des) | 2 hours |

Measurement of the sulfur level in the hydrotreat effluent demonstrates that essentially all of the sulfur in the feed is converted to hydrogen sulfide. During the adsorption portion of the cycle, no detectable amount of sulfur (hydrogen sulfide) is noted in the stream exiting the adsorber.

After the cycle is switched to desorption, the hydrogen sulfide level in the desorption effluent is monitored. An integration of the sulfur level versus time is performed for both the absorption feed and the desorption effluent. The comparison verifies that all sulfur entering with the adsorption feed leaves with the desorption effluent, confirming that no unsteady phenomena occurs.

The following sets forth the results of a pilot plant run at the above-stated parameters using Samples 1, 5, 6 and 14 described in Example I. The capacity of the adsorbent for $H_2S$ was determined as follows:

$$\Delta W = \frac{100\, n\, M_{HC}\, C_S (M_{H2S}/(M_s)\, t_b}{W_{ads}}$$

where;

$\Delta W$ = delta loading (g/100 g)
n = molar flow rate (gmol/min)
$M_{HC}$ = hydrocarbon molecular weight (g/gmol)
$C_S$ = S concentration in liquid HC (gS/gHC)
$M_{H2S}$ = $H_2S$ molecular weight (g/gmol)
$M_S$ = S molecular weight (g/gmol)
$t_b$ = breakthrough time (minutes)
$W_{ads}$ = weight of absorbent (g)

TABLE 5

| | Pilot Plant Run |
|---|---|
| Sample | Adsorption Capacity, $gH_2S$/100 g ads. 425° F. |
| 1 | 0.29 |
| 5 | 0.76 |
| 6 | 0.45 |
| 14 | 0.29 |

It can be seen from the data presented in Table 5 that Samples 5 and 6, the barium-exchanged clinoptilolites, performed substantially better in adsorbing $H_2S$ from hydrocarbons than did Sample 1, Zeolite 4A. In fact, even the chloride loaded clinoptilolite, Sample 14, performed as well as clean Zeolite 4A. It can be seen that the degree of enhancement in adsorption capacity shown in Table 3 was greater than what is shown in Table 5. One possible explanation for the difference in the degree of enhanced results is that the feed to the pilot plant and the screening unit was different. The feedstream to the screening unit was supplied from a gas cylinder containing hydrogen sulfide in helium. The feedstream to the pilot plant, on the other hand, utilizes a liquid hydrocarbon feed that is doped with diethyl sulfide. Therefore, there may have been some hydrocarbon co-adsorption or pore blocking occurring during the pilot plant test. Nonetheless, the increase in adsorption capacity observed during the pilot plant tests was unexpected and was substantially enhanced over the standard 4A material.

In order to demonstrate the resistance of the clinoptilolite molecular sieves of the present invention to a halide environment (as compared to the performance in a halide environment as discussed above), Samples 1, 4, 5, 6 were loaded into a McBain Quartz Spring Balance System and were cycled repeatedly to simulate adsorption and desorption steps by changing the HCl partial pressure in the McBain apparatus from 4 torr to about 100 torr at a temperature of 200° to 400° C. for a period of three weeks. The x-ray crystallinity of these samples before and after HCl treatment was measured. The x-ray crystallinity is defined as the percentage of total peak area remaining after the chloride treatments. The apparatus and procedure used to obtain the x-ray diffraction patterns are well known to those skilled in the art and need not be further disclosed herein. The x-ray pattern provided 2-theta angle and D-spacing values by height and by area, as well as peak area, peak height and relative intensity. The relative crystallinity of the samples before and after treatment was evaluated by taking the ratio of the peak area with 2-theta in the range of 22.28–23.29 and 29.91–31.99.

Table 6 set forth the x-ray crystallinities for the four samples noted above.

TABLE 6

| | Halide Stability |
|---|---|
| Sample No. | X-ray Crystallinity, % Peak Area Remaining After Treatment |
| 1 | 0 |
| 4 | 82 |
| 5 | 73 |
| 6 | 70 |

It can be seen that Sample No. 1 (Zeolite 4A) is totally unsuitable for use in a halide environment. In fact, the crystallinity of the chloride sample was completely destroyed. On the other hand, it can be seen that clinoptilolite Samples 4, 5 and 6 substantially retained crystallinity after the chloride treatment.

The invention is hereafter described with reference to the drawing which is provided for illustrative purposes and is not intended to be a limitation on the scope of the claims that follow.

Referring now to FIG. 1, a liquid hydrocarbon feedstream containing hydrocarbons in the pentane-hexane carbon range, and about 400 ppmv of sulfur-bearing compounds and about 50 mol. % hydrogen is passed to the process by line 10 to heat exchanger 101 wherein it is heated to a temperature of about 206° F. by indirect heat exchange with stream No. 22, the source of which is hereinafter defined, and withdrawn by line 11 and further heated to a temperature of about 250° F. in heat exchanger 102 by indirect heat exchange with line 20, the source of which is hereinafter defined. The partially heated feedstream is withdrawn by line 12 and passed to heat exchanger 103 where it is further heated to a temperature of about 365° F. by indirect heat exchange with line 26, the source of which is hereinafter defined and withdrawn by line 13 and heated to a temperature of about 570° F. in fired heater No. 104.

From heater 104 the feedstream is passed by line 14 to hydrotreating reactor 105 in which essentially all of the sulfur and sulfur-bearing compounds are converted to hydrogen sulfide by reacting hydrogen in the presence of a catalyst suitable for such purpose. As noted above, such a hydrotreating reaction is well known to those in the art and is conventionally used in the typical hydrotreating isomerization process and is discussed for example in U.S. Pat. No. 4,533,529. Hydrotreater 105 contains a hydrotreating catalyst such as those containing metals of Groups VB, VIB, VIII and the Rare Earth Series of the Periodic Table defined by Mendeleff, published as the "Periodic Table of the Elements" in Perry and Chilton, *Chemical Engineers Handbook,* 5th Edition. The catalysts may be supported or unsupported, although catalysts supported on a refractory inorganic oxide, such as on a silica, alumina or silica-alumina base are preferred. The preferred catalysts are those containing one or more of the metals cobalt, molybdenum, iron, chromium, vanadium, thorium, nickel, tungsten (W) and uranium (U) added as an oxide or sulfide of the metal. Typical hydrotreating catalysts include Shell 344 Co/Mo (Shell Chemical Co., Houston, Tex.), C20-5, C20-6, C20-7, C20-8 Co/Mo hydrotreating catalysts (United Catalysts, Inc., Louisville, Ky.), and the like.

The hydrotreater effluent is withdrawn from reactor 105 by line 15 and is passed to heat exchanger 106 wherein it is cooled by indirect heat exchange with line 24, the source of which is hereinafter defined, to a temperature of about 300° F. before being passed to adsorber vessel 107 which contains a suitable quantity of barium ion-exchanged clinoptilolite adsorbent as prepared in accordance with Example I, Sample 6 of the present invention and formed by conventional techniques to produce 8×12 particles. An adsorption effluent stream substantially free of hydrogen sulfide is withdrawn from adsorber bed 107 by line 17 and is passed through guard bed 108 which contains a suitable adsorbent material such as zinc oxide as a safety precaution in the event that some hydrogen sulfide breaks through into line 17. The hydrogen sulfide depleted effluent stream is withdrawn by line 18 and combined with hydrogen chloride supplied by line 19 to form line 20 which is passed to heat exchanger 102 wherein it is cooled to a temperature of about 270° F. by indirect heat exchange with line 11 as hereinbefore described.

The isomerization reactor feed is withdrawn by line 21 and passed to a first isomerization reaction vessel 109 which contains a suitable quantity of an isomerization catalyst containing platinum metal on an alumina support. Isomerization catalysts of the type described above can be obtained from UOP, Des Plaines, Ill. A first isomerization reactor effluent is withdrawn from isomerization reactor 109 and passed by line 27 to heat exchanger 101 wherein it is cooled to a temperature of about 240° F. by indirect heat exchange with line 10 as hereinbefore described and passed by line 23 to a second isomerization reactor 110 wherein it is further reacted to convert the normal paraffins to isoparaffins. A reactor hydrocarbon product stream is withdrawn from reactor 110 by line 24 and is passed to heat exchanger 106 wherein it is heated by indirect heat exchange with line 15 as hereinbefore described to a temperature of about 500° F., and is passed by line 25 to adsorber vessel 111 which is undergoing desorption.

It is to be understood that adsorber vessels 107 and 111 are each repeatedly cycled between the adsorption and desorption steps such that one adsorber is always available to receiver adsorber feed from line 16. It is to be understood that at least two beds are preferred in order to provide a relatively continuous operation. A desorption effluent stream containing reactor hydrocarbon product and hydrogen sulfide is withdrawn from adsorber 111 by line 26 and passed to heat exchanger 103 wherein it is cooled to a temperature of about 300° F. by indirect heat exchange with line 12 as hereinbefore described. A cooled product stream is withdrawn by line 27 and passed to distillation tower 112 wherein the product is separated into a light fraction comprising hydrogen sulfide and hydrogen withdrawn by line 28 and a heavy fraction comprising the isomerized hydrocarbons withdrawn by line 29.

What is claimed is:

1. A process for separating hydrogen sulfide from a feedstream containing hydrogen sulfide and hydrocarbons, which comprises contacting the feedstream in an adsorber bed with a clinoptilolite molecular sieve ion-exchanged with a barium cation in a concentration effective to cause hydrogen sulfide to be selectively adsorbed on the clinoptilolite molecular sieve, wherein said concentration of the barium cation in said clinoptilolite molecular sieve is from about 20 to about 95 equivalent percent of the ion-exchangeable cations in said clinoptilolite molecular sieve, and withdrawing an effluent stream having a reduced amount of hydrogen sulfide relative to the feedstream.

2. A process according to claim 1 wherein the clinoptilolite molecular sieve has been ion-exchanged with at least one other cation selected from lithium, sodium, calcium, magnesium, zinc, copper, cobalt, iron and manganese cations, to an extent that not more than about 95 equivalent percent of the ion-exchangeable cations are cations from said group.

3. A process according to claim 2 wherein from about 1 to 30 equivalent percent of the ion-exchangeable cations in the clinoptilolite are sodium cations.

4. A process according to claim 2 wherein from about 1 to 30 equivalent percent of the ion-exchangeable cations in the clinoptilolite are calcium cations.

5. A process according to claim 1 wherein said contacting is conducted at a temperature greater than about 200° F.

6. A process for separating hydrogen sulfide from a feedstream comprising hydrogen sulfide and hydrocarbons having from about 4 to 12 carbon atoms per molecule, comprising:

(a) passing the feedstream at adsorption conditions to an adsorber bed containing a clinoptilolite molecular sieve ion-exchanged with a barium cation in a concentration effective to cause hydrogen sulfide to be selectively adsorbed on the clinoptilolite molecular sieve, wherein said concentration of the barium cation in said clinoptilolite molecular sieve is from about 20 to about 95 equivalent percent of the ion-exchangeable cations in said clinoptilolite molecular sieve, and withdrawing an adsorption effluent stream having a reduced concentration of hydrogen sulfide relative to the feedstream; and (b) passing a purge gas through the adsorber bed at desorption conditions effective to cause hydrogen sulfide to be desorbed from the clinoptilolite molecular sieve, and withdrawing a desorption effluent stream having an increased concentration of hydrogen sulfide relative to the purge gas.

7. A process according to claim 6 wherein the adsorption conditions include an adsorption temperature of from about 200° to 500° F. and the desorption conditions include a desorption temperature that is higher than the desorption temperature and from about 300° to 700° F.

8. A process according to claim 7 wherein the adsorption temperature is from about 200° to 400° F. and the desorption temperature is from about 300° to 600° F.

9. A process according to claim 7 wherein the adsorption temperature is from about 400° to 600° F. and the desorption temperature is from about 500° to 700° F.

10. A process according to claim 6 wherein the adsorption conditions include an adsorption pressure greater than 50 psia and the desorption conditions include a desorption pressure lower than the adsorption pressure.

11. A process according to claim 6 wherein the purge gas comprises at least a portion of the adsorption effluent stream.

12. A process according to claim 6 comprising contacting at least a portion of the adsorption effluent stream with a hydrocarbon conversion catalyst that is sulfur-sensitive, and withdrawing a reactor effluent stream comprising a hydrocarbon reactor product.

13. A process according to claim 12 wherein the purge gas comprises at least a portion of the reactor effluent stream.

14. A process according to claim 13 wherein the hydrocarbon conversion catalyst is an isomerization catalyst, the feedstream comprises normal paraffins having from about 4 to 6 carbon atoms per molecule and the reactor hydrocarbon product comprise at least one of isobutane, isopentane, 2-methyl pentane, 3-methyl pentane, 2,2-dimethylbutane and 2,3-dimethylbutane.

15. A process according to claim 13 wherein the hydrocarbon conversion catalyst is a reforming catalyst, the feedstream comprises paraffinic hydrocarbons having from about 6 to 10 carbon atoms per molecule and the reactor hydrocarbon product has an increased concentration of aromatic hydrocarbons relative to the adsorption effluent stream.

16. A process according to claim 13 wherein the purge gas comprises halides.

17. A process according to claim 13 wherein the feedstream, adsorption effluent stream and the reactor effluent stream are maintained substantially in the vapor phase.

18. A process according to claim 6 wherein at least two adsorber beds are provided and each bed is repetitively cycled between steps (a) and (b) such that step (a) is performed in each bed for a length of time of from about 0.5 to 6 hours per cycle.

19. A process according to claim 6 comprising passing a raw feed comprising hydrocarbons and organic sulfur compounds to a hydrotreating reaction zone containing a hydrotreating catalyst at effective conditions to convert the organic sulfur compounds to hydrogen sulfide and withdrawing the feedstream.

20. A process according to claim 12 comprising admixing at least a portion of the reactor hydrocarbon product with other blending components to form a motor fuel.

* * * * *